US008006882B2

(12) United States Patent
Kameda et al.

(10) Patent No.: US 8,006,882 B2
(45) Date of Patent: Aug. 30, 2011

(54) STAPLE CARTRIDGE IN STAPLER

(75) Inventors: Futoshi Kameda, Chuo-ku (JP); Nobuaki Yagi, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 224 days.

(21) Appl. No.: 12/424,218

(22) Filed: Apr. 15, 2009

(65) Prior Publication Data

US 2009/0266864 A1 Oct. 29, 2009

(30) Foreign Application Priority Data

Apr. 25, 2008 (JP) ..... 2008-115364
Apr. 25, 2008 (JP) ..... 2008-115368

(51) Int. Cl.
*B27F 7/38* (2006.01)

(52) U.S. Cl. ..... 227/120; 227/87; 227/131; 227/136

(58) Field of Classification Search ..... 227/131, 227/120, 119, 87, 136, 8, 82
See application file for complete search history.

(56) References Cited

U.S. PATENT DOCUMENTS 3,009,618 A * 11/1961 Hershey Lerner ..... 226/162
4,588,121 A * 5/1986 Olesen ..... 227/120
5,273,199 A * 12/1993 Logtens ..... 227/87
5,346,114 A * 9/1994 Udagawa et al. ..... 227/120
5,560,529 A * 10/1996 Udagawa et al. ..... 227/136
6,039,230 A * 3/2000 Yagi et al. ..... 227/120
6,899,258 B2 * 5/2005 Haramiishi ..... 227/2
6,918,527 B2 * 7/2005 Hakozaki et al. ..... 227/131
7,017,789 B2 * 3/2006 Mochizuki et al. ..... 227/119
7,143,921 B2 * 12/2006 Hakozaki et al. ..... 227/120
7,377,414 B2 * 5/2008 Kishi et al. ..... 227/120
2002/0017547 A1 2/2002 Mochizuki

FOREIGN PATENT DOCUMENTS

| | | |
|---|---|---|
| CN | 1316339 | 10/2001 |
| CN | 1617788 | 5/2005 |
| EP | 0 637 487 A1 | 2/1995 |
| EP | 1 122 043 A2 | 8/2001 |
| EP | 1 428 629 A1 | 6/2004 |
| JP | 2003-62766 | 3/2003 |
| JP | 2003-517938 | 6/2003 |

* cited by examiner

*Primary Examiner* — Scott A. Smith
(74) *Attorney, Agent, or Firm* — Drinker Biddle & Reath LLP

(57) ABSTRACT

A staple cartridge is detachably arranged in a body of a stapler. The staple cartridge includes a cartridge body for accommodating a staple belt in which a plurality of rod-shaped staples are connected to each other and rolled into a roller-shape and a guide member for guiding the staples at a time of forming leg portions of the staples or after forming the leg portions.

5 Claims, 8 Drawing Sheets

STAPLE CARTRIDGE IN STAPLER

FIELD OF THE INVENTION

The present disclosure relates to a staple cartridge accommodating a staple belt in which a plurality of staples are rolled into a roller-shape, the stable cartridge detachably arranged in a body of a stapler.

DESCRIPTION OF RELATED ART

A published Japanese translation of PCT international publication for patent application (the Japanese translation No. JP-T-2003-517938) disclose a stapler in which a cassette (referred to as a cartridge) for accommodating belt-shaped staples (referred to as a roll-shaped staple belt) in which rod-shaped staples, which have not been formed yet, are connected to each other and rolled into a roller-shape so that the plurality of staples can be continuously driven out from the stapler.

The cassette has a shaper and driver which are arranged so that they can be reciprocated. In the above stapler, after the staples have been successively formed into a C-shape, that is, after a pair of leg portions haven been formed in each staple, the staples are driven out by a driver.

In some related-art cartridges, only the roll-shaped staple belt is replaced with another one in the cartridge body.

In JP-T-2003-517938, both the shaper and the driver are arranged in the cassette. Therefore, the constitution is complicated and expensive. Further, when the cassette is replaced with a new one, the shaper and the driver are also discarded together with the cassette, which is waste of resources.

Further, in JP-T-2003-517938, the stapler does not include a face plate which is a member used for removing a nail which a driver failed in driving. That is, it is impossible for a user to touch a cassette, which has once charged into Stapler, with the hands. Accordingly, in JP-T-2003-517938, even when a plurality of nails remain in the cassette at the time of failing in driving a nail, the user can not do anything without replacing the cassette with a new one, that is, the staple cartridge is not handy.

In the type in which only the roll-shaped staple belt is charged into the cartridge body, a joint is necessarily formed between a new and an old staple belt at the time of replacing the roll-shaped staple belt. Therefore, double feeding occurs in which the staples are put on each other when they are fed. In order to prevent the occurrence of this double feeding, it is necessary to enhance the accuracy of the height of the staple feeding passage in the staple guide unit. Alternatively, it is necessary to enhance the accuracy of the height of the feeding pawl for feeding the staple. In this connection, this feeding pawl is arranged in the cartridge. Further, it is necessary to enhance an amount of feeding. Furthermore, it is necessary to execute the inspection of accuracy.

Concerning the material of this cartridge, in general, the cartridge body is formed out of synthetic resin such as plastics. On the other hand, the cartridge includes a metallic member such as a staple guide which functions as a guide when it comes into contact with staples made of metal.

In the case where the staples accommodated in the cartridge have been used up and the cartridge is discarded, in order to facilitate the reuse of usable resources, it is necessary to classify members into the members made of synthetic resin and the members made of metal and do away with the classified members. An unexamined patent publication application No. JP-A-2003-62766 discloses the technique in which a thin thickness groove is provided in a cartridge body and the cartridge body is divided into two with respect to this thin thickness groove so that metallic members such as a spring can be classified.

In JP-A-2003-62766, the cartridge body is divided into two by the hands. Therefore, in order to divide the cartridge body, it is necessary for an operator to give a considerably strong force to the cartridge body.

SUMMARY OF INVENTION

Illustrative aspects of the present invention provide a simple, inexpensive and handy staple cartridge in stapler.

According to a first aspect of the invention, a staple cartridge, detachably arranged in a body of a stapler, is provided with a cartridge body for accommodating a staple belt in which a plurality of rod-shaped staples are connected to each other and rolled into a roller-shape and a guide member for guiding the staples at a time of forming leg portions of the staples or after forming the leg portions.

According to a second aspect of the invention, the staple cartridge may be further comprising a face plate arranged so that a driving passage for driving out a staple is opened.

According to a third aspect of the invention, the cartridge body may be made of synthetic resin and the guide member may be made of metal, and the guide member may be assembled to the cartridge body so that the staples, which the leg portions have not been formed yet, serve as a stopper of the guide member.

In this case, the guide member is a staple guide which functions as a receiving table at the time of bending a rod-shaped staple into a C-shape, that is, at the time of forming a leg portion of the staple. Alternatively, the guide member is a pusher for pushing the leg portions of the staple so that the leg portions can be on the same line as that of the driver.

DETAILED DESCRIPTION OF EXEMPLARY EMBODIMENTS

Referring to FIGS. 1 to 7, a staple cartridge in a stapler, which is an embodiment of the present invention, will be explained below. In the embodiment, explanations will be made into a case in which the stapler is of the electrically operated type and staples, which are rolled into a roller-shape, are accommodated in a staple cartridge. The electrically operated type stapler, which will be referred to as "stapler" hereinafter, are incorporated, for example, into a copier or a facsimile terminal device and used for automatically stapling a predetermined number of sheets of paper processed by the copier or the facsimile terminal device.

Figure 1:
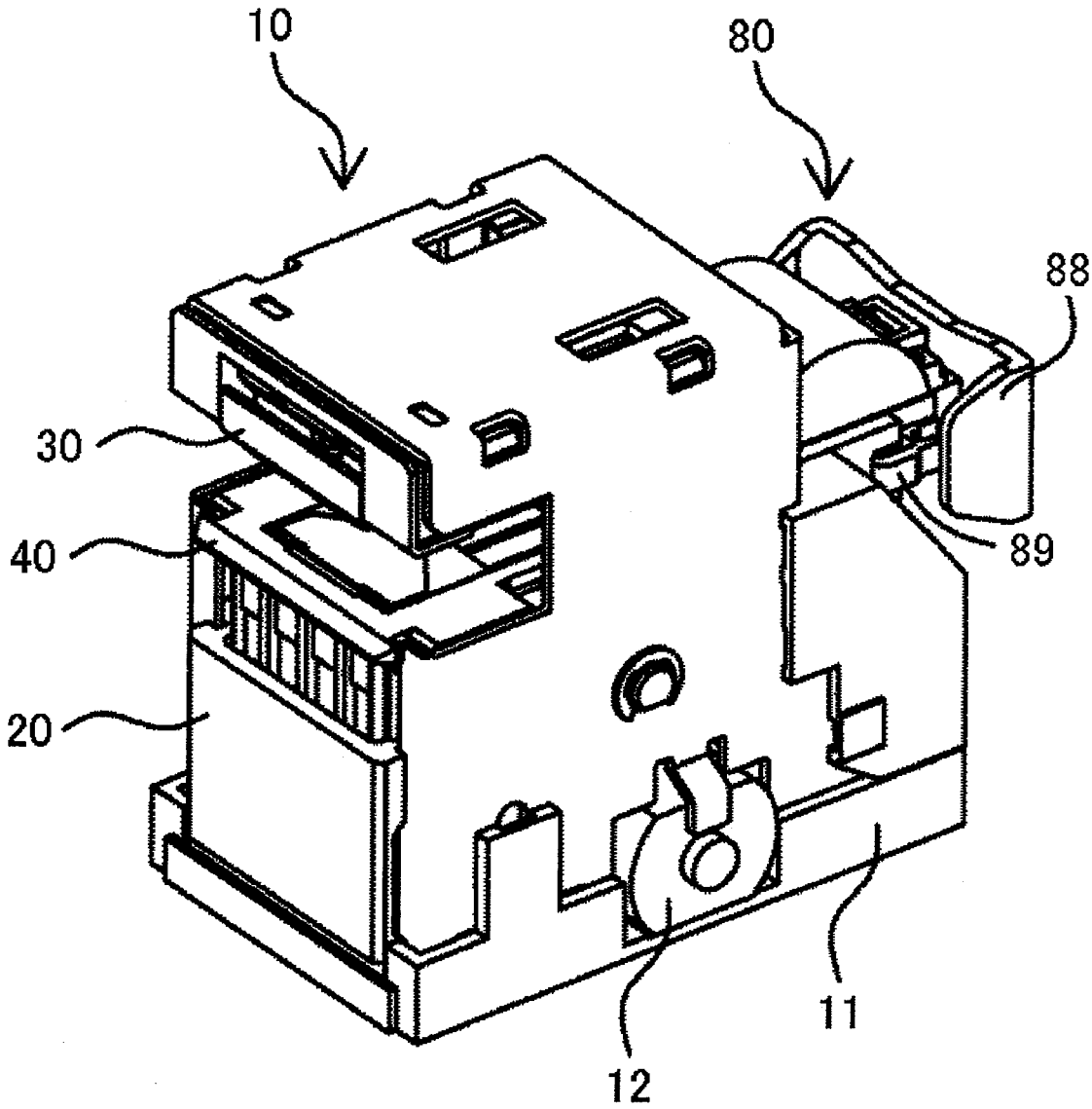
FIG. 1 is an overall perspective view of a stapler of an embodiment according to the present invention.
Figure 2:
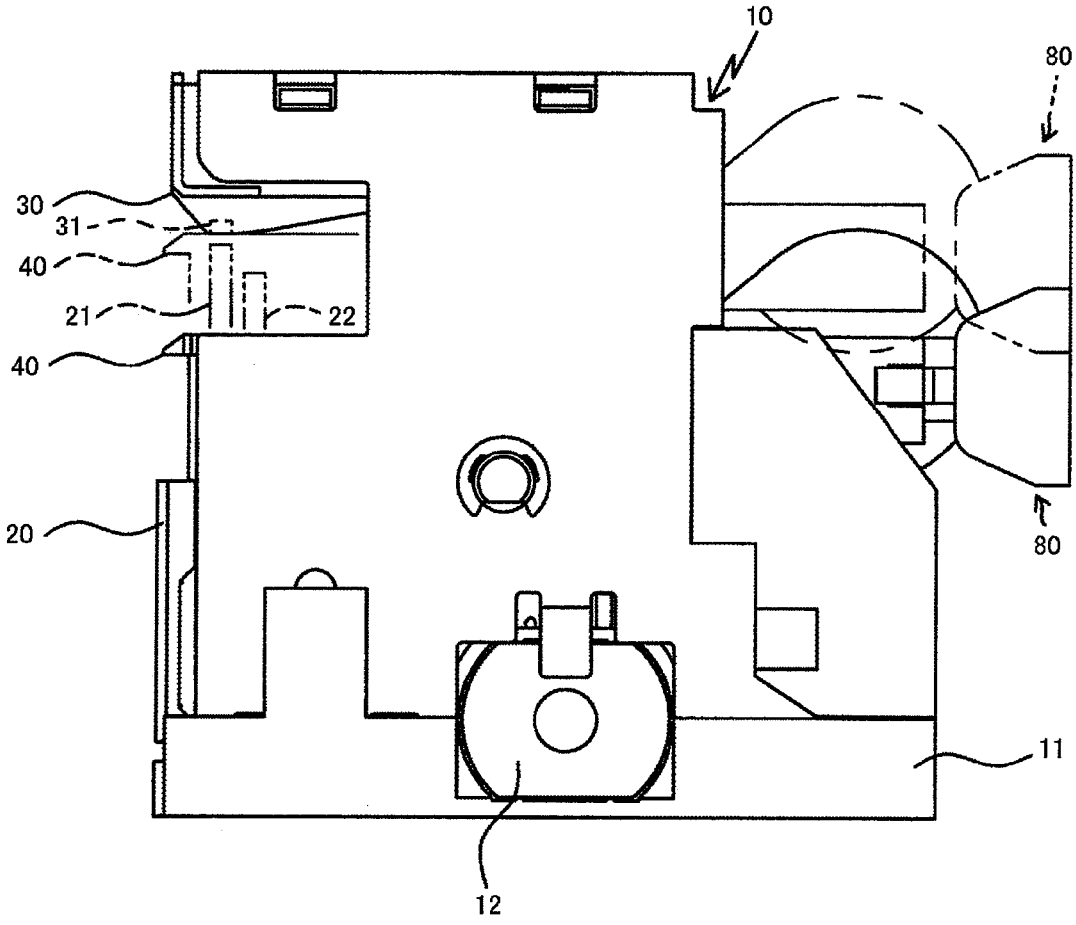
FIG. 2 is a side view of the stapler shown in FIG. 1.
Figure 3:
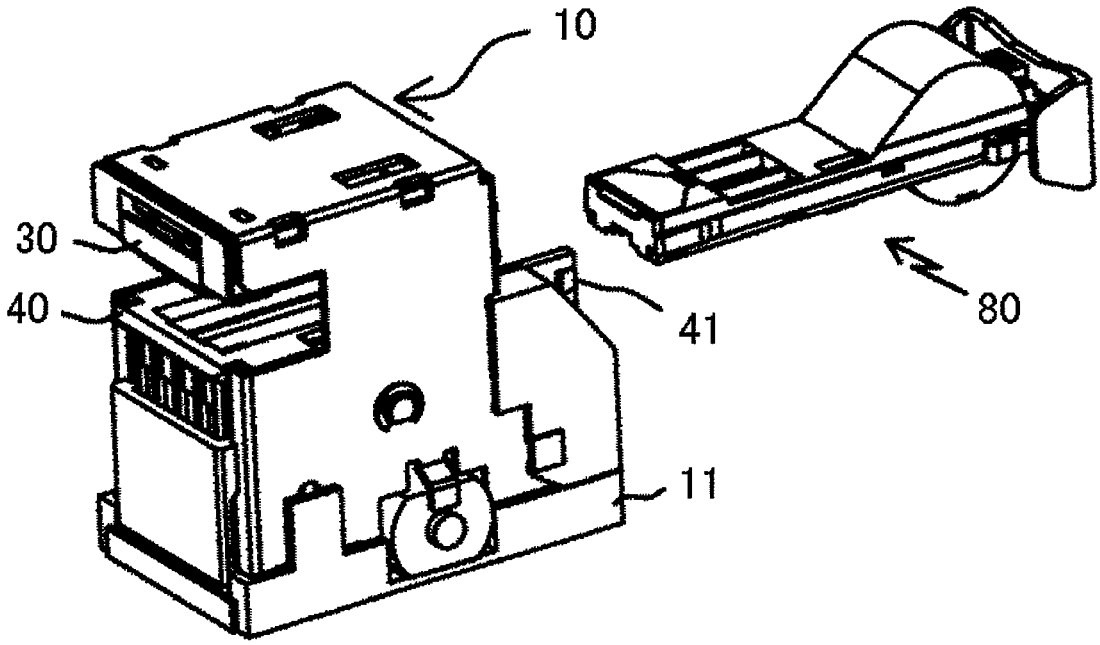
FIG. 3 is a perspective view showing a state in which the staple cartridge has been removed from the body of the stapler shown in FIG. 1.
Figure 4:
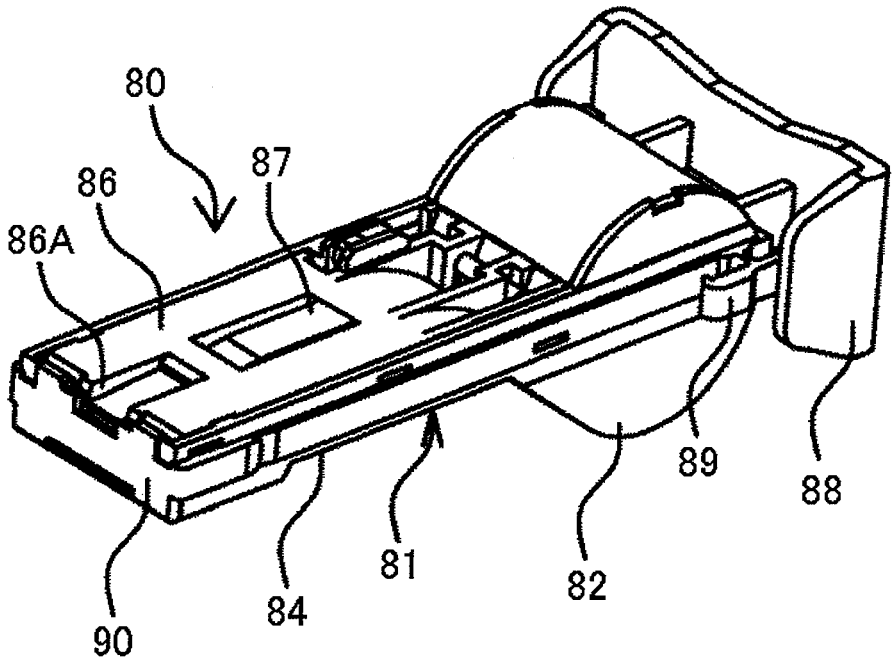
FIG. 4 is an overall perspective view of the staple cartridge shown in FIG. 3.
Figure 5:
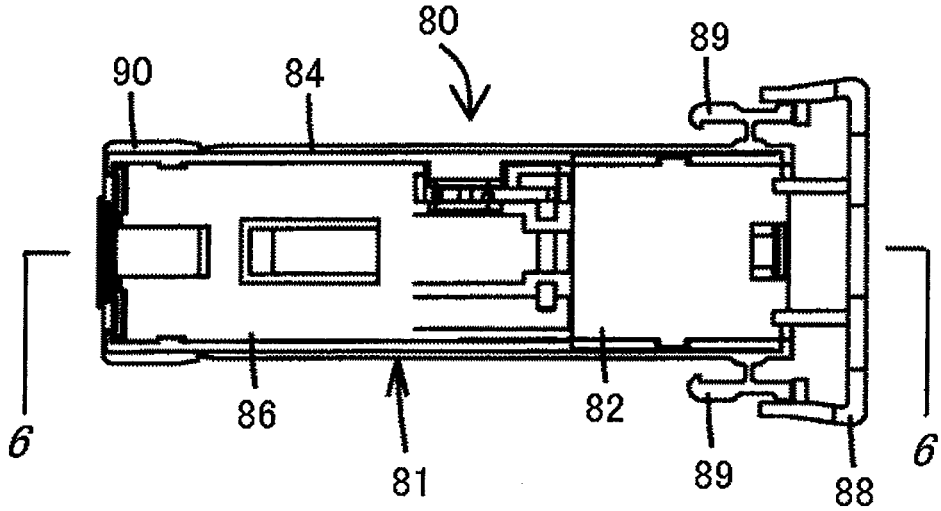
FIG. 5 is a plan view of the staple cartridge shown in FIG. 4.
Figure 6:
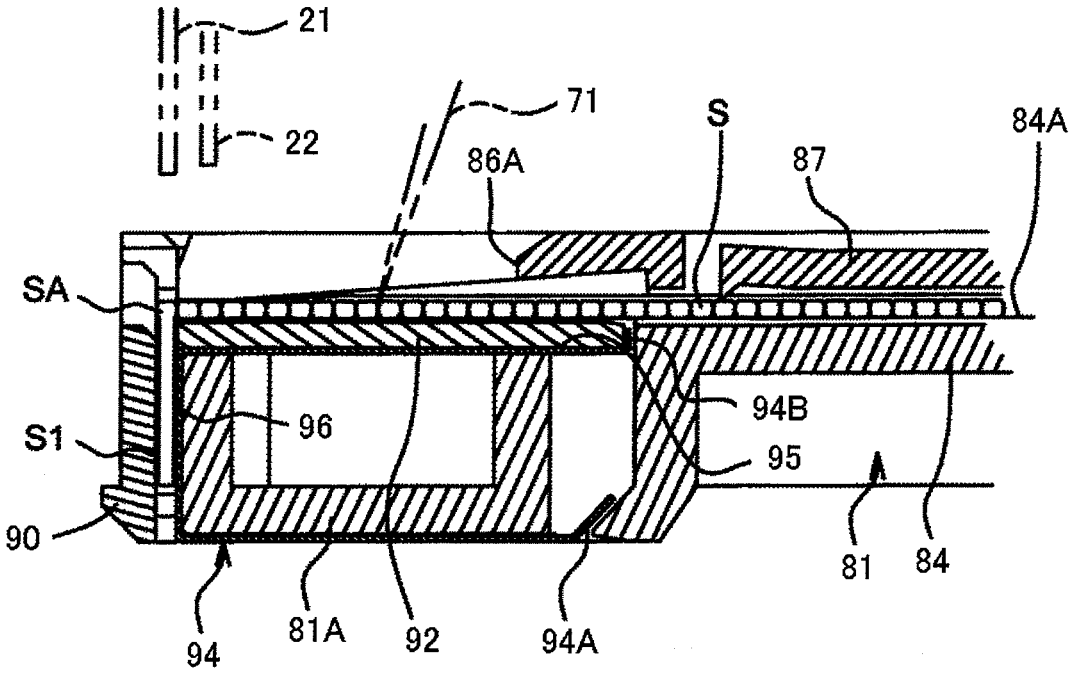
FIG. 6 is an enlarged sectional view of a primary portion which is taken on line 6-6 in FIG. 5.
Figure 7:
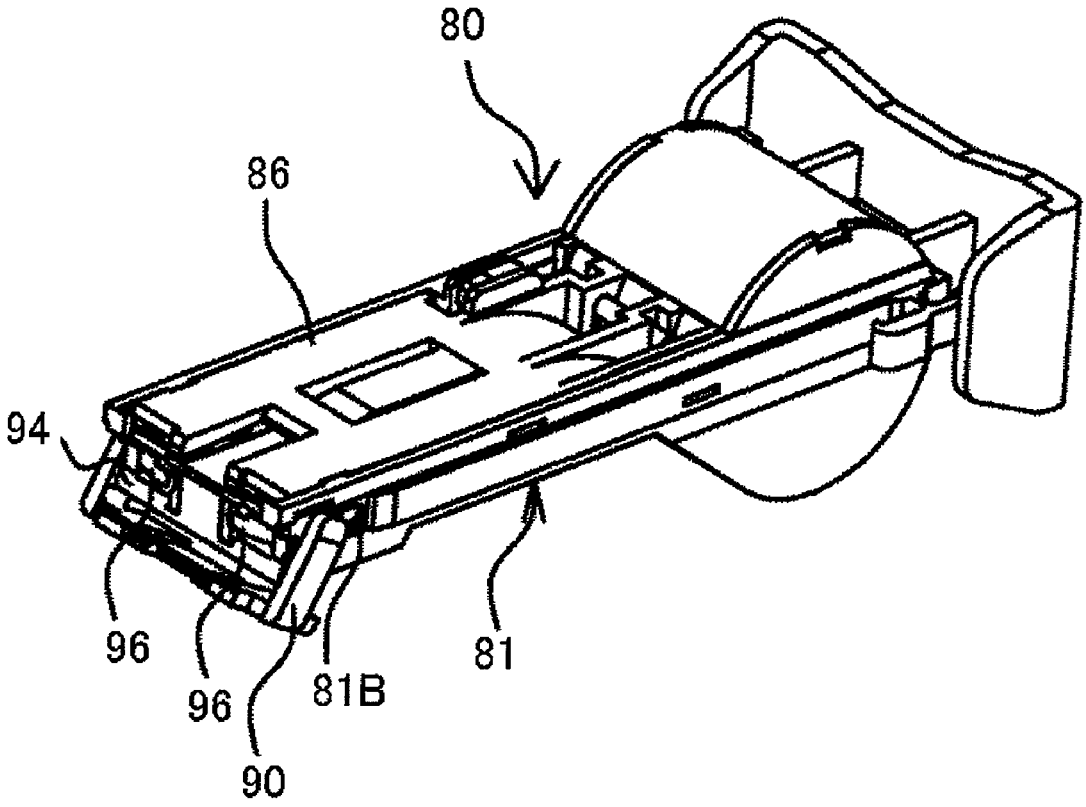
FIG. 7 is an overall arrangement view showing a state in which the face plate shown in FIG. 4 is opened.

Further, the stapler is composed so that the staple cartridge can be attached to and detached from the stapler. In this connection, FIG. 1 is an overall perspective view of the stapler of the embodiment. FIG. 2 is a side view of the stapler shown in FIG. 1. FIG. 3 is a perspective view showing a state in which the staple cartridge has been removed from the body of the stapler shown in FIG. 1. FIG. 4 is an overall perspective view of the staple cartridge shown in FIG. 3. FIG. 5 is a plan view of the staple cartridge shown in FIG. 4. FIG. 6 is an enlarged sectional view of a primary portion which is taken on line 6-6 in FIG. 5. FIG. 7 is an overall perspective view showing a state in which the face plate shown in FIG. 4 is rotated.

As shown in FIGS. 1 to 3, a stapler 10 includes a body 11 composing a frame and others. The stapler 10 also includes: a motor 12; a driver link 20; a driver 21 shown by the two-dotted chain line in FIG. 2; a forming plate 22 shown by the two-dotted chain line in FIG. 2; a table 30; and a magazine 40.

The magazine 40 is attached with a staple cartridge 80. The magazine 40 is held through a spring (not shown) being separate from the driver link 20 by a threshold distance. The magazine 40 and the driver link 20 are elevated by the motor 12. Concerning this matter, refer to the two-dotted chain line in FIG. 2. The driver 21 and the forming plate 22 are fixed to the driver link 20 shown in FIG. 2. The forming plate 22, which is a forming means, is a plate for forming the rod-shaped staple S, which has not been formed yet, shown in FIG. 6, into a C-shape. Specifically, the forming plate 22 is a plate for forming the leg portion S1 of the staple S. The driver 21 is a plate for driving out the staple SA, the leg portion of which has already been formed, which is located at the most front end portion, into sheets of paper to be stapled not shown.

The table 30 is always pushed onto the magazine 40 side through a spring not shown. As shown by the two-dotted chain line in FIG. 2, on the table 30, the clincher 31 is arranged being opposed to the driver 21. The clincher 31 is a receiving table for bending the leg portion S1 of the staple SA driven out by the driver 21.

A staple sensor not shown is arranged in the stapler 10. When the staple sensor is turned on, CPU not shown judges that the number of the remaining staples S is small, that is, CPU judges that all staples S have been substantially used up. Therefore, CPU forcibly stops the stapling operation and gives a warning to an operator so as to replace the staple cartridge 80.

As shown in FIG. 4, the staple cartridge 80 includes: a cartridge body 81 made of synthetic resin; a face plate 90; a staple guide 92 made of metal which is a guide member; and a pusher 94 made of metal shown in FIG. 6. The cartridge body 81 includes: an accommodating portion 82; a leading portion 84; a cover 86; and a knob 88. The knob 88 is arranged at the rear end of the cartridge body 81. A plane shape of the knob 88 is formed into a substantial C-shape so that it can be held at the time of attaching the cartridge body 81 to the magazine 40. FIG. 4 is a perspective view of the stapler 10 taken from the opposite side to FIG. 3.

As shown in FIG. 4, the accommodating portion 82 is formed into a substantial cylindrical shape on the front side of the knob 88. A belt of the staples S, which are rolled into a roller-shape, are accommodated in the accommodating portion 82. A section of the leading portion 84 is formed into a substantial C-shape so that the leading portion 84 can be continued to the substantial center of the accommodating portion 82. The staples S accommodated in the accommodating portion 82 are successively sent to the driving passage shown in FIG. 6 through the leading portion 84 (through the head portion 81A of the cartridge body 81) by the feeding needle 71 of the feeding mechanism arranged in the body 11 of the stapler 10.

The cover 86 is formed into a plate-shape for covering the leading portion 84. At the substantial center of the cover 86, the pressing piece 87 is integrally formed. As shown in FIG. 6, the pressing piece 87 presses the staples S, which are successively fed, against the feeding face 84A side of the leading portion so that the staples S can be positioned. At the same time, the pressing piece 87 prevents the staples S from being fed in the opposite direction in the leading portion 84. The substantially rectangular opening 86A is formed on the feeding direction side of the cover 86. The feeding pawl 71 described before is inserted into the opening 86A and the staples S are sent to the forward end.

A plane shape of the face plate 90 is formed into a C-shape as shown in FIGS. 5 and 7. As shown in FIG. 6, the face plate 90 covers the front end of the head portion 81A of the cartridge body 81 so as to form a driving passage of the staples SA. At the front end portion of the face plate 90, a pair of protrusions not shown is formed. These protrusions are engaged in the groove 81B shown in FIG. 7 of the cartridge body 81 as shown in FIG. 4. As shown in FIG. 7, the face plate 90 rotates round the protrusion in a threshold angular range.

In the case where a nail, which the driver 21 failed to drive, or a nail, which the clincher 31 failed to clinch, remains in the driving passage, by rotating the face plate 90 as shown in FIG. 7, the driving passage is opened and the nail, which the driver failed to drive, that is, the jammed nail can be removed.

The face plate 90 may be made of metal. Even in this case, when the protrusion is disengaged from the groove 81B, the face plate 90 can be easily disengaged from the cartridge body 81. Only a portion of the face plate 90 may be made of metal. Specifically, a portion of the face plate 90 composing the driving passage may be made of metal. Even in this case, when the metallic portion is of the fitting type, the face plate 90 can be easily removed.

As shown in FIG. 5, in the cartridge body 81, a pair of engaging pieces 89 is integrally formed on the knob 88 side. The engaging pieces 89 are engaged with the stopper 41 shown in FIG. 3 formed in the magazine 40 and the staple cartridge 80 is attached to the magazine 40. The staples S of the embodiment are respectively formed into a rod-shape before the staples S are formed into a C-shape. A plurality of staples S are continued to each other by a tape not shown. Concerning this matter, refer to FIG. 6.

Figure 10:
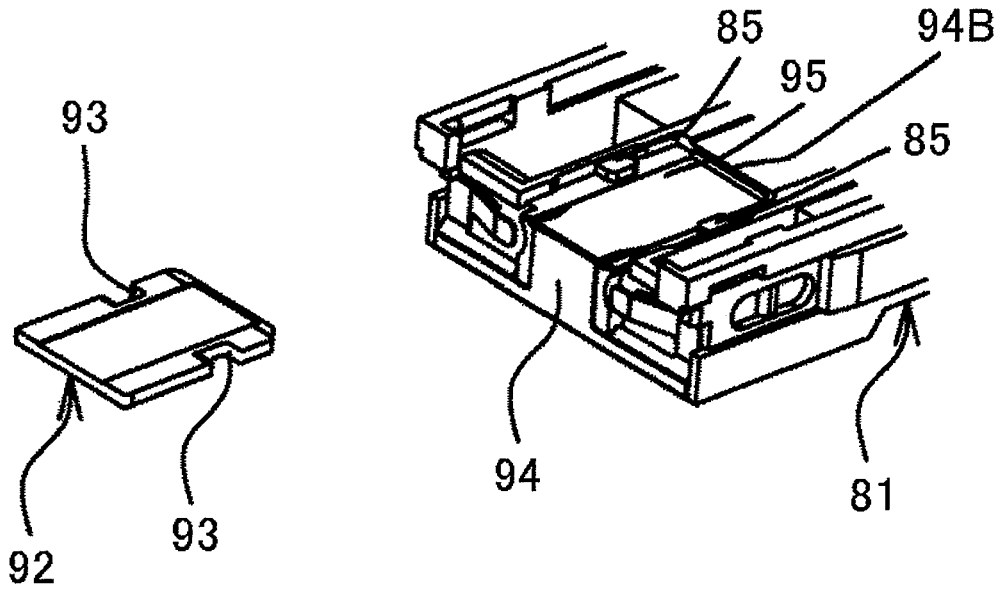
FIG. 10 is a perspective view showing a state in which the staple guide shown in FIG. 8 is removed from the cartridge body.

The staple guide 92 made of metal is formed into a substantial flat-plate-shape as shown in FIG. 10. The staple guide 92 becomes a receiving table used when the rod-shaped staples S shown in FIG. 6 are formed being bent into a C-shape by the forming plate 22. As shown in FIG. 10, in the staple guide 92, a pair of groove portions 93 are formed. The groove portions 93 are respectively engaged with a pair of stoppers 85, which are formed in the leading portion 84, and positioned.

Figure 12:
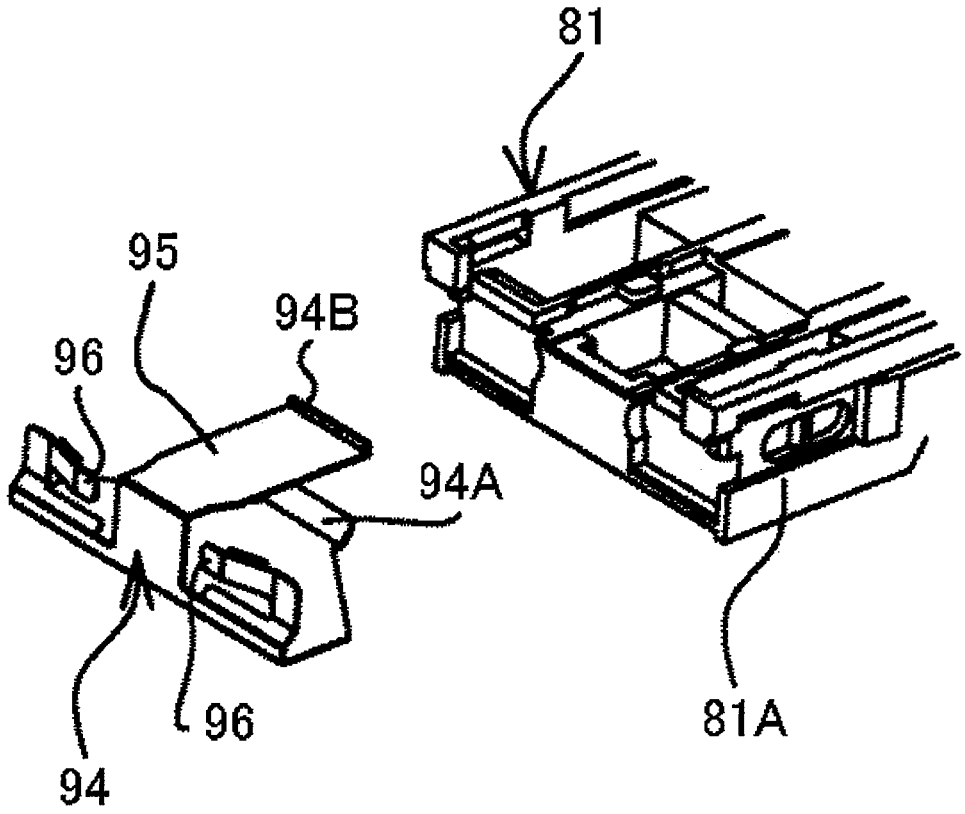
FIG. 12 is a perspective view showing a state in which the pusher shown in FIG. 10 is removed from the cartridge body.

As shown in FIG. 12, the pusher 94 is fitted and engaged in the head portion 81A of the cartridge body 81. That is, as shown in FIG. 6, the engaging piece 94A of the pusher 94 is engaged with the head portion 81A. As shown in FIG. 6, on the face 95 (shown in FIG. 12) of the pusher 94, the staple guide 92 is put and the setting is previously made so that the staple guide 92 and the feeding face 84A can be on the same face. That is, the assembling structure of the staple cartridge is composed in such a manner that the staples S, which are articles of consumption, hold the staple guide 92 and the pusher 94. In other words, the staples S, which are articles of consumption, function as a stopper for preventing the components from coming out.

As shown in FIG. 12, in the pusher 94, a pair of spring pieces 96 are integrally formed corresponding to the leg portions S1 (shown in FIG. 6) of the staples SA. The spring piece 96 pushes the staples SA so that the leg portions S1 of the staples SA can be on the same line as that of the driver, that is, the leg portions S1 of the staples SA can be vertical. The stopper piece 94B are formed being bent at an end portion of the face 95 of the pusher 94. When the staple guide 92 is made to agree with the stopper piece 94B, an end edge of the staple guide 92 is arranged so that it can correspond to the forming plate 22.

Action of the Present Embodiment is explained hereafter.

As shown in FIG. 6, the staple S is bent by the forming plate 22 so as to form the leg portion S1 and then the staple SA is driven out by the driver 21 to sheets of paper (not shown) to be stapled. The leg portion S1 of the staple SA, which has penetrated the sheets of paper to be stapled, is bent by the clincher 31 (shown in FIG. 2) which is arranged being opposed to the driver 21.

On the other hand, in the case where the nail described before, which the driver 21 failed to drive, remains in the driving passage, as shown in FIG. 7, when the face plate 90 is rotated and the driving passage of the cartridge body 81 is opened, the nail, which the driver 21 failed to drive, that is, the jammed nail is removed. According to the embodiment, the face plate 90 for arranging the driving passage so that it can be opened is provided. Therefore, a so-called jam processing, in which the jammed nail is removed, can be executed. Accordingly, the staple cartridge 80 becomes handy.

When a warning that the staples S have been used up is given, the staple cartridge 80 is replaced with a new one and the old staple cartridge 80 is scraped, that is, the old staple cartridge 80 is disposed. First, as shown in FIG. 3, the staple cartridge 80 is detached from the magazine 40 and the new staple cartridge 80 is attached to the magazine 40. On the other hand, in order to scrap the staple cartridge 80 which has already been used up, the staples S made of metal, which remain because they have not been used up, the staple guide 92 and the pusher 94 are classified from the staple body 81 and scrapped.

According the embodiment, in the staple cartridge 80, no feeding mechanism including the feeding needle 71 is arranged other than the forming plate 22 and the driver 21. Accordingly, the constitution of the staple cartridge 80 can be made simple and the manufacturing cost is inexpensive. Further, when the staple cartridge 80 is scrapped, the number of the scrapped parts can be reduced, that is, the members to be scrapped, which can be used as resources, can be reduced.

In the embodiment, the staple cartridge 80 for accommodating a roller-shaped staple belt is arranged in the body of Stapler 11 so that it can be replaced. Therefore, double feeding of the staples can be avoided. That is, the high accuracy is not required for the height of the feeding passage or the feeding pawl. For example, it is possible to eliminate the staple guide unit or reduce an amount of feed of nails. Further, it is unnecessary to execute the accuracy inspection. Accordingly, the manufacturing cost can be reduced as compared with the conventional staple cartridge.

Therefore, according to the embodiment, the constitution of the staple cartridge 80, the number of parts of which is necessarily minimized, can be made simple. Accordingly, the staple cartridge 80 can be of the disposable type, the manufacturing cost of which is inexpensive.

Further, a way of which the staple guide 92 and the pusher 94 are classified from the staple body 81 and scrapped is explained hereinafter. First, as shown in FIG. 3, the staple cartridge 80 is detached from the magazine 40 and the new staple cartridge 80 is attached to the magazine 40. On the other hand, in order to scrap the staple cartridge 80 which has already been used up, as shown in FIG. 7, the face plate 90 is rotated and a driving passage of the cartridge body 81 is opened.

Figure 8:
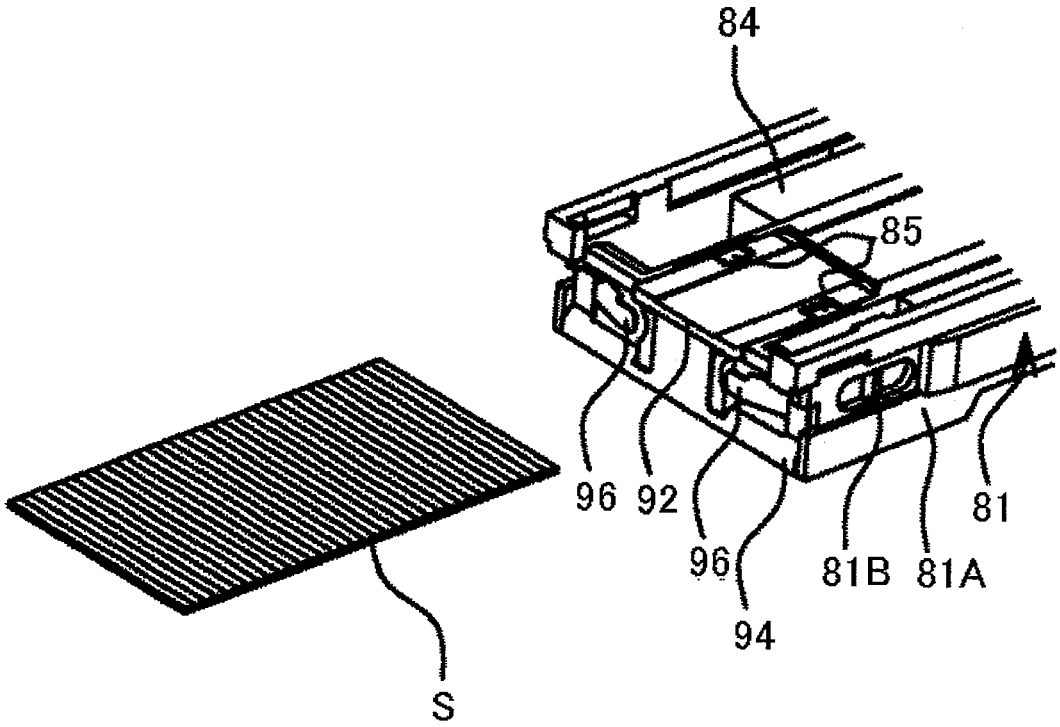
FIG. 8 is a perspective view showing a state in which the staples shown in FIG. 6 are removed from the cartridge body.

Successively, as shown in FIG. 8, in the case where the metallic staples S remain because they have not been used up, the metallic staples S are taken out. In other words, as shown in FIG. 6, in the case where the staples S remain in the leading portion 84, the staples S become a stopper and it is impossible to detach the staple guide 92 and the pusher 94 from the staple body 81.

In this case, in order to clearly illustrate the detachment of the staple guide 92 and the pusher 94, the cover 86 and the face plate 90 are omitted in the illustrations of FIGS. 8, 10 and 12. The face plate 90 may be previously detached before the table guide 92 and the pusher 94 are detached.

Figure 9:
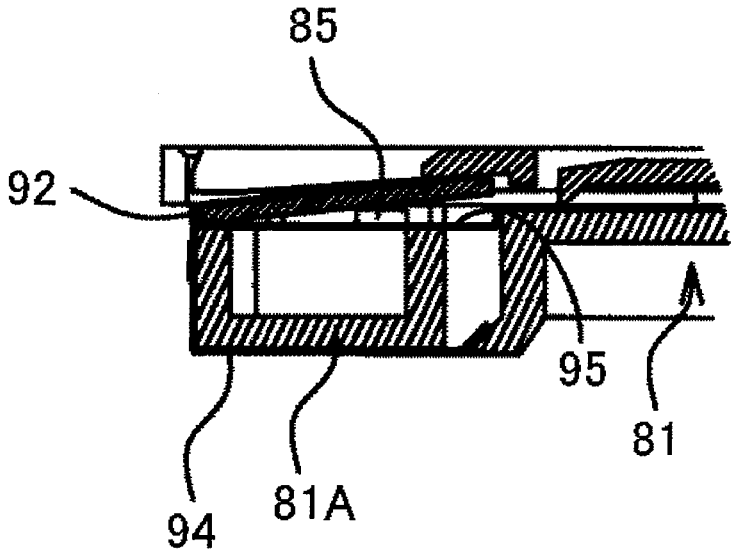
FIG. 9 is a sectional view for explaining a process in which the staple guide shown in FIG. 6 is removed from the cartridge body.
Figure 11:
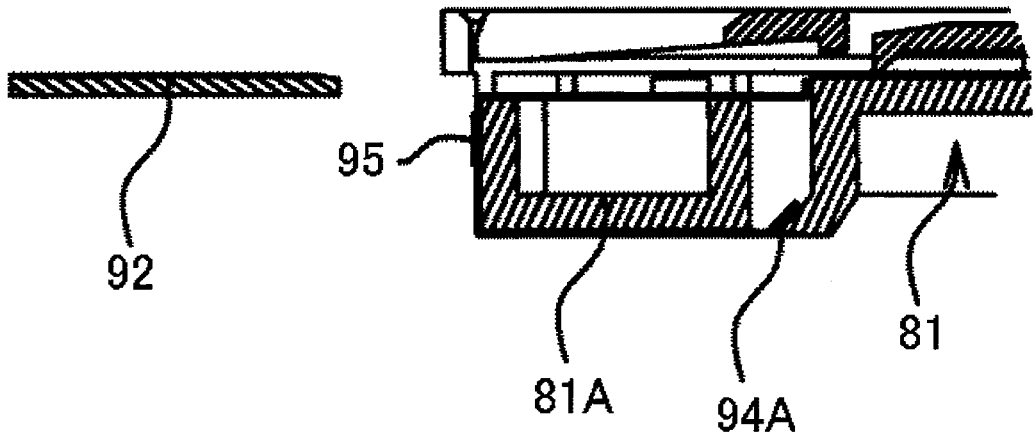
FIG. 11 is a sectional view showing a state in which the staple guide shown in FIG. 9 is removed from the cartridge body.

Next, when the staples S are taken out, that is, when no obstacles exist, as shown in FIG. 9, the groove portion 93 (shown in FIG. 10) of the staple guide 92 and the stopper 85 are disengaged from each other. Then, as shown in FIGS. 10 and 11, the staple guide 92 can be detached from the cartridge body 81.

Figure 13:
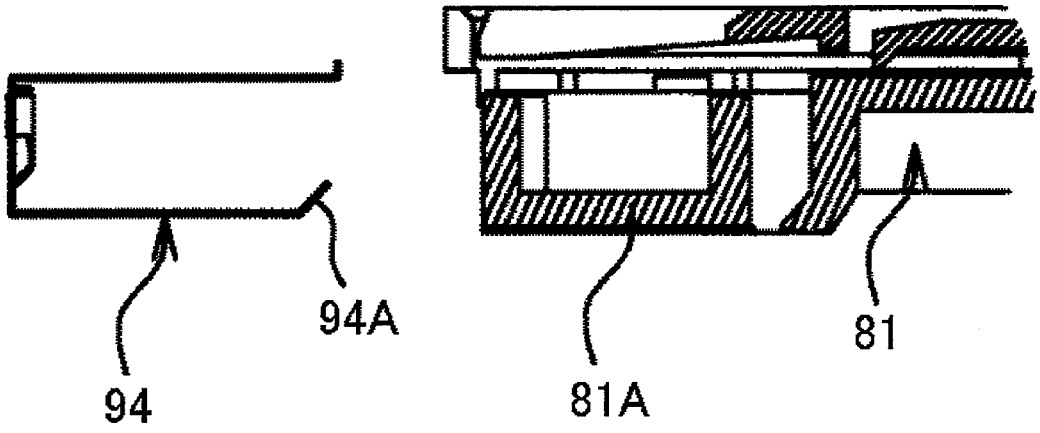
FIG. 13 is a sectional view showing a state in which the pusher shown in FIG. 11 is removed from the cartridge body.

Finally, since no staples S and staple guide 92 exist, that is, since no obstacles exist, as shown in FIGS. 12 and 13, the engaging piece 94A of the pusher 94 and the head portion 81A of the cartridge body are disengaged from each other and the pusher 94 is removed from the cartridge body 81. In the embodiment, when the staples S are removed from the inside of the cartridge body 81, no obstacles exist. Therefore, when the staple guide 92 made of metal is disengaged from the cartridge body 81 or the pusher 94 made of metal is disengaged from the cartridge body 81, the staple guide 92 or the pusher 94 can be simply removed.

The staple guide 92 and the pusher 94 are engaged with and assembled to the cartridge body 81 so that the staple S can be a stopper. Therefore, without using any tools or without dividing the cartridge body 81 into pieces, that is, specifically, without giving a force to divide the cartridge body 81 into pieces, it is possible to simply classify the cartridge body 81, the staple guide 92 and the pusher 94.

According to the present embodiment, it is possible to classify the cartridge body 81 made of synthetic resin, the staple guide 92 made of metal and the pusher 94 made of metal and the thus classified components can be scrapped or collected. Therefore, it is possible to save resources and prevent the environmental pollution. As described before, it is possible to take the staple cartridge 80 apart into pieces after it has been used up. Therefore, it is possible to prevent recharging the staples. Further, it is possible to prevent the reuse of the staple cartridge 80.

In the embodiment, the staple cartridge of the electrically operated stapler is taken up as an example. However, it is possible to apply the present invention to a staple cartridge of a manually operated stapler. The present embodiment is an example in which the face plate 90 is arranged in the staple cartridge 80. However, in the present invention, the face plate may be arranged on the stapler body side. In this case, at the time of jam processing, after the staple cartridge has been removed, the jammed nails remaining on the face plate are taken out from the stapler body side.

In the embodiment, a staple cartridge is used in which staples rolled into a roller-shape are accommodated. However, it is possible to apply the present invention to a staple cartridge for accommodating a plurality of sheet-shaped staples which are laminated.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A staple cartridge detachably arranged in a body of a stapler, comprising:

a cartridge body for accommodating a staple belt in which a plurality of rod-shaped staples are connected to each other and rolled into a roller-shape;

a face plate for forming a driving passage for driving out the staples; and a guide member for guiding the staples at a time of forming leg portions of the staples and after forming the leg portions, wherein the staple belt, before forming leg portions, serves as a stopper which prevents the guide member from being removed from the cartridge body, the guide member is detachably engaged with the cartridge body, and the face plate is rotatably arranged so that the driving passage is opened to remove the guide member from the cartridge body.

2. The staple cartridge according to claim 1 wherein the cartridge body is made of synthetic resin and the guide member is made of metal.

3. The staple cartridge according to claim 1, further comprising:

a pusher, wherein the pusher is a unitary member, and a pair of spring pieces for biasing the leg portions of the staples are integrally formed in the pusher.

4. The staple cartridge according to claim 1, wherein the cartridge body includes an accommodating portion for directly accommodating the staple belt, and a leading portion for sending the staples toward the face plate, and the guide member includes a staple guide for guiding the staples at the time of forming the leg portions of the staples, and a pusher for guiding the staples after forming the leg portions.

5. The staple cartridge according to claim 4, wherein the staple guide is engaged with the cartridge body so as to be on a substantially same face as a feeding face of the leading portion, and the pusher includes a face on which the staple guide is disposed, and a stopper piece for receiving the staple guide is formed on the face of the pusher.

* * * * *